US008571426B2

(12) United States Patent
Kubota et al.

(10) Patent No.: US 8,571,426 B2
(45) Date of Patent: Oct. 29, 2013

(54) TONER SUPPLY METHOD, DEVELOPMENT DEVICE, PROCESS UNIT, AND IMAGE FORMING APPARATUS

(75) Inventors: Tomohiro Kubota, Osaka (JP); Naoki Nakatake, Hyogo (JP); Atsushi Takehara, Kyoto (JP); Tomofumi Yoshida, Osaka (JP); Sho Tsuritani, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 167 days.

(21) Appl. No.: 13/185,743

(22) Filed: Jul. 19, 2011

(65) Prior Publication Data

US 2012/0033982 A1 Feb. 9, 2012

(30) Foreign Application Priority Data

Aug. 3, 2010 (JP) ..... 2010-174587

(51) Int. Cl.
*G03G 15/08* (2006.01)

(52) U.S. Cl.
USPC ..... 399/27; 399/29

(58) Field of Classification Search
None
See application file for complete search history.

(56) References Cited

U.S. PATENT DOCUMENTS 7,003,233 B2 * 2/2006 Matsuda et al. ..... 399/27
7,676,184 B2 3/2010 Murayama et al.
7,885,566 B2 2/2011 Konishi et al.
2009/0060533 A1 * 3/2009 Yamaguchi ..... 399/27
2011/0064473 A1 3/2011 Fujita et al.

FOREIGN PATENT DOCUMENTS

JP 2006-65079 3/2006
JP 2006-065079 A * 3/2006 ..... G03G 15/08
JP 4026977 10/2007

OTHER PUBLICATIONS

U.S. Appl. No. 13/025,266, filed Feb. 11, 2011, Atsushi Takehara, et al.
U.S. Appl. No. 13/013,224, filed Jan. 25, 2011, Kohta Sakaya, et al.

* cited by examiner

*Primary Examiner* — Clayton E Laballe
*Assistant Examiner* — Jas Sanghera
(74) *Attorney, Agent, or Firm* — Oblon, Spivak, McClelland, Maier & Neustadt, L.L.P.

(57) ABSTRACT

A toner supply method includes detecting whether a remaining toner amount in the development device is equal to or greater than a first remaining amount, supplying a first supply amount of toner to the development device in a first supply mode when the remaining toner amount is not greater than the first remaining amount, detecting whether the remaining toner amount in the development device is equal to or greater than a second remaining amount smaller than the first remaining amount, and supplying a second supply amount, smaller than the first supply amount, of toner to the development device in a second supply mode when the remaining toner amount is reduced to or below the second remaining amount.

20 Claims, 5 Drawing Sheets

TONER SUPPLY METHOD, DEVELOPMENT DEVICE, PROCESS UNIT, AND IMAGE FORMING APPARATUS

CROSS-REFERENCE TO RELATED APPLICATIONS

This patent specification is based on and claims priority from Japanese Patent Application No. 2010-174587, filed on Aug. 3, 2010 in the Japan Patent Office, which is hereby incorporated by reference herein in its entirety.

BACKGROUND OF THE INVENTION

1. Field of the Invention

The present invention relates to a development device, process unit, and image forming apparatus, and more particularly to a toner supply method for an image forming apparatus incorporating the development device and process unit.

2. Description of the Related Art

In electrophotographic image forming apparatuses, generally, a surface of an image bearer is charged uniformly, and then an exposure unit exposes the surface of the image bearer with, for example, a laser, according to image data, thus forming a electrostatic latent image thereon. Subsequently, a development device supplies developer (i.e., toner) to the surface of the image bearer with a development member such as a development roller, thereby developing the latent image into a toner image. The development device includes a toner containing compartment for containing a predetermined amount of toner for reliable image development, and an agitator that agitates the toner therein to give the toner a uniform electrostatic charge. The toner contained in the development device is consumed in image development, and the amount of toner remaining therein is detected by a toner detector. When the toner detector detects that the remaining toner amount is reduced to a predetermined amount, fresh toner is supplied to the development device from a replaceable toner container connected to the development device.

It is known that the charge properties of the toner inside the development device (hereinafter also "remaining toner") are degraded gradually as the toner is agitated by the agitator. The deterioration in charge properties makes developing performance unstable. In this state, it is possible that image density fluctuates or toner scatters on backgrounds of images, which are ordinarily not exposed and should be kept free of toner. By contrast, charge properties of fresh toner (hereinafter also "supplied toner") supplied from the toner container are not degraded. Consequently, when a large mount of fresh toner is supplied to the development device in which only a small amount of toner remains, the charge properties of the toner present in the development device change significantly after the supply of toner, affecting the developing performance. In view of the foregoing, several approaches, described below, have been tried to minimize fluctuations in charge properties of toner. For example, JP-2006-65079-A proposes controlling the amount of supplied toner to keep the amount of remaining toner substantially constant.

More specifically, in this approach, the amount of supplied toner is adjusted in response to the toner consumption as well as the amount of toner remaining in the development device to keep the amount of remaining toner substantially constant. Although this approach is effective as long as the toner is supplied constantly, if toner is not supplied to the development device timely and then a large amount of toner is supplied all at once, the charge properties of the toner therein can fluctuate dramatically.

More specifically still, although fresh toner is usually supplied from the toner container when the amount of toner remaining in the development device falls below the predetermined amount, fresh toner cannot be supplied when the toner container is empty. If development becomes unfeasible at the moment the toner container becomes empty, the printing job is suspended, which is inconvenient for users. Therefore, even when the toner container is empty, image development is generally continued using the toner remaining in the development device till a predetermined quantity. Additionally, when the toner container becomes empty, the apparatus generally indicates that the toner container should be replaced. However, when image development is continued with only the remaining toner after the toner container becomes empty, the remaining toner amount is smaller than usual. If the toner container is replaced in this state and fresh toner is supplied therefrom, the ratio of fresh toner to the remaining toner increases abruptly. As a result, developing performance becomes unstable, increasing toner scattering on the background and degrading the image quality.

SUMMARY OF THE INVENTION

In view of the foregoing, an illustrative embodiment of the present invention provides a toner supply method to supply toner from a replaceable toner container to a development device. The method includes a step of detecting whether a remaining toner amount in the development device is equal to or greater than a first remaining amount, a step of supplying a first supply amount of toner to the development device in a first supply mode when the remaining toner amount is not greater than the first remaining amount, a step of detecting whether the remaining toner amount in the development device is equal to or greater than a second remaining amount smaller than the first remaining amount, and a step of supplying a second supply amount, smaller than the first supply amount, of toner to the development device in a second supply mode when the remaining toner amount is reduced to or below the second remaining amount.

Another illustrative embodiment of the present invention provides a development device to which toner is supplied from a replaceable toner container in the above-described method. The development device includes a casing defining a toner containing compartment for containing toner, in which a toner supply inlet to connect to a replaceable toner container is formed, a cylindrical toner carrier partially exposed from the casing of the development device to carry the toner to a development range, and a toner detector to detect a remaining toner amount in the toner containing compartment. When the remaining toner amount is not greater than a first remaining amount, a first supply amount of toner is supplied from the toner container to the toner containing compartment in a first supply mode, and, when the remaining toner amount is reduced to or below a second remaining amount smaller than the first remaining amount, a second supply amount smaller than the first supply amount of toner is supplied to the toner containing compartment in a second supply mode.

Another illustrative embodiment of the present invention provides an image forming apparatus that includes an image bearer on which an electrostatic latent image is formed, and the above-described development device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
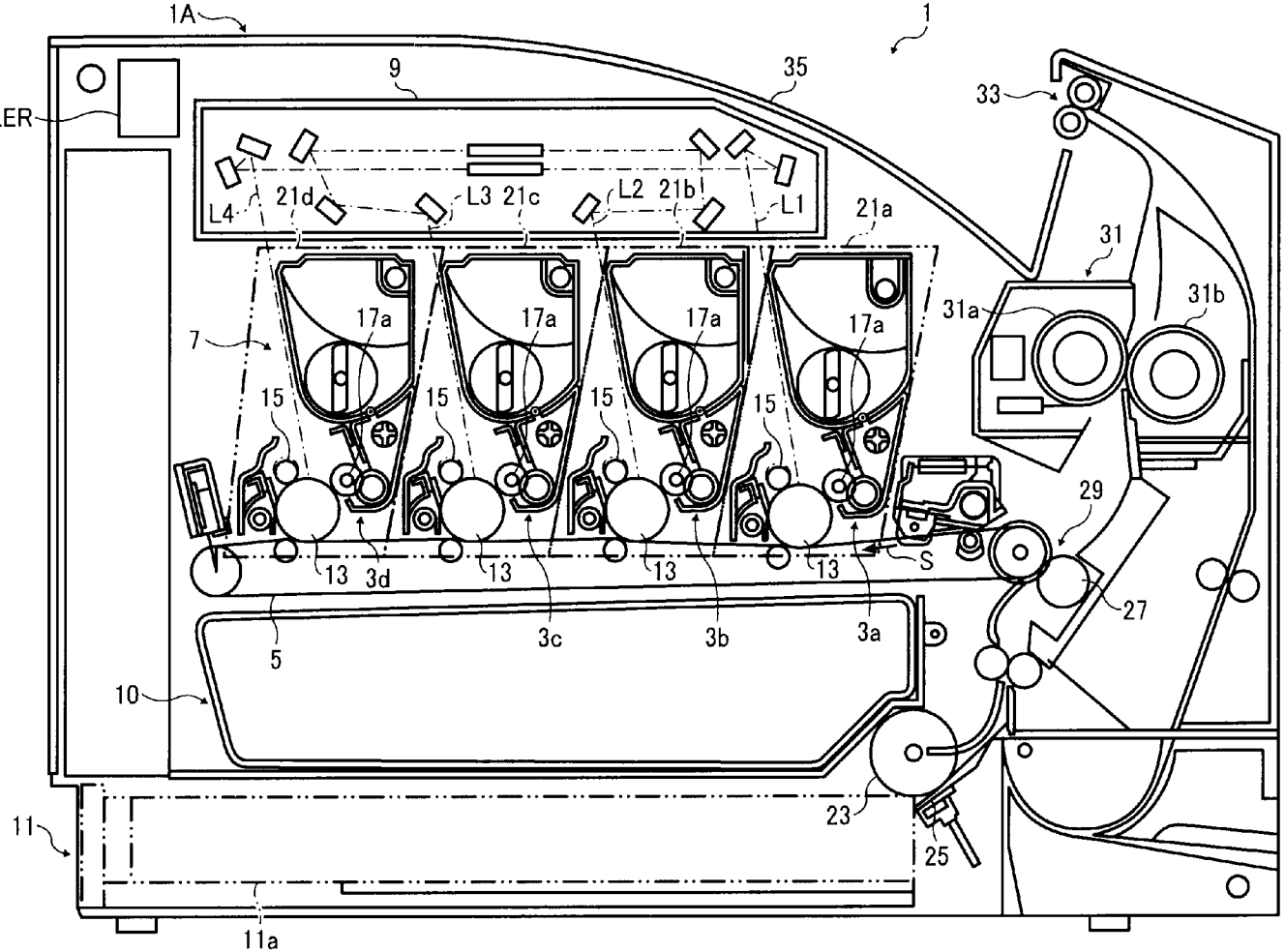
FIG. 1 is a schematic view illustrating a configuration of an image forming apparatus that includes development devices according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It is to be noted that the term "process unit" used in this specification means a unit that is removably installable in an apparatus body of an image forming apparatus, in which an image bear and one of 1) a changer and a developer bearer or a cleaning unit; 2) at least one of the charger, the developer bearer, and the cleaning unit; and 3) the developer bearer are housed in a common unit casing.

Referring now to the drawings, wherein like reference numerals designate identical or corresponding parts throughout the several views thereof, and particularly to FIG. 1, a multicolor image forming apparatus according to an illustrative embodiment of the present invention is described.

Image Forming Apparatus

FIG. 1 is a schematic cross-sectional view of an image forming apparatus that in the present embodiment is a multicolor printer capable of forming multicolor images. However, image forming apparatuses as embodiments of the present invention are not limited to printers but may be copiers, facsimile machines, or multifunction having two or more of these capabilities.

Referring to FIG. 1, an image forming apparatus 1 includes image forming units 3*a*, 3*b*, 3*c*, and 3*d* each of which including a photoreceptor 13 (shown in FIG. 2), serving as a latent image bearer, and related components for performing changing, development, and cleaning processes on the photoreceptor 13. The photoreceptor 13 and the related components are housed in a common unit casing for each color and configured as a process unit 21*a*, 21*b*, 21*c*, or 21*d*.

The image forming apparatus 1 in the present embodiment is tandem type, and the image forming units 3*a*, 3*b*, 3*c*, and 3*d* are arranged in parallel in a direction in which an intermediate transfer belt 5 extends. The intermediate transfer belt 5 serves as an intermediate transfer member onto which single-color toner images formed in the respective image forming units 3 are transferred sequentially.

The multiple image forming units 3 together form a tandem image forming unit 7 positioned in a vertical center portion of a housing 1A of the image forming apparatus 1. The image forming apparatus 1 further includes an optical scanning unit 9 provided above the tandem image forming unit 7, a waste-toner container 10, a sheet feeder 11, and a controller 100. The waste-toner container 10 and the sheet feeder 11 are provided beneath the tandem image forming unit 7. The sheet feeder 11 includes a sheet cassette 11*a* for containing sheets of recording media such as transfer sheets. The optical scanning unit 9 selectively scans the respective photoreceptors 13 with laser beams L1 through L4 (hereinafter also collectively "laser beams L") according to image data. The controller 100 is configured as a central processing unit (CPU) with associated volatile and nonvolatile memory devices, and executes control and other programs stored in the memory devices to achieve the various functions and capabilities described herein.

Figure 2:
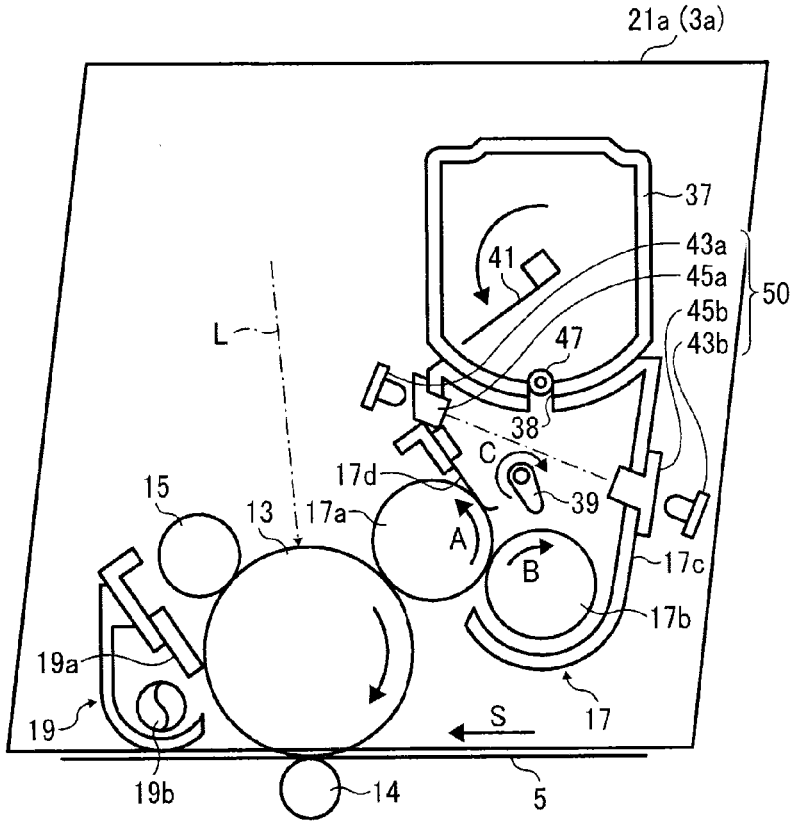
FIG. 2 is a schematic end-on axial view of a process unit included in the image forming apparatus shown in FIG. 1.

FIG. 2 is an end-on axial view that illustrates a configuration of the image forming unit 3*a*.

It is to be noted that the image forming units 3 have a similar configuration and only the image forming unit 3*a* is described below, thus omitting descriptions of other image forming units 3.

Referring to FIG. 2, the image forming unit 3*a* includes the rotatable drum-shaped photoconductor (hereinafter also "photoreceptor drum") 13 constituting the image bearer, and, around the photoreceptor 13, a charging roller 15, a development device 17, and a cleaning unit 19 are provided. The charging roller 15 is disposed in contact with the photoreceptor drum 13. The development device 17 includes a development roller 17*a* serving as a developer bearer to develop an electrostatic latent image formed on the photoreceptor drum 13 and a supply roller 17*b* to supply toner to the development roller 17*a*. The cleaning unit 19 includes a blade 19*a* disposed in contact with the photoreceptor drum 13 to scrape off toner remaining thereon and a conveyance screw 19*b* to transport the toner removed therefrom. Although all of the above-described components are united as the process unit 21*a* in the configuration shown in FIG. 2, it is not necessary. The photoreceptor 13 and at least one of the above-described components may be united into the process unit 21*a*.

Additionally, a transfer roller 14 is provided at a position facing the photoreceptor 13 via the intermediate transfer belt 5. In the process unit 21*a*, the charging roller 15 uniformly charges the photoreceptor drum 13 to a high electrical potential in the dark, initializing the electrical potential thereon. Then, the optical scanning unit 9 scans the photoreceptor drum 13 with the laser beam L (exposure process), causing the electrical potential thereon to partly decay, creating high potential portions and low potential portions. Thus, an electrostatic latent image is formed thereon. The development device 17 supplies toner to the low potential portions (or high potential portions) of the electrostatic latent image, thus developing the electrostatic latent image into a toner image (development process). The developed image (toner image) is transferred to the intermediate transfer belt 5 at a position between the photoreceptor drum 13 and the transfer roller 14, which is referred as a primary-transfer position or primary-transfer nip.

The housing of the process unit 21*a* can accommodate the development device 17, and, as the photoreceptor drum 13 rotates clockwise, the toner image is transported in the circumferential direction of the photoreceptor drum 13 toward the primary-transfer position.

Primary-Transfer Process

Referring to FIG. 1, the above-described latent image formation and image development in the process units 21*a*, 21*b*, 21*c*, and 21*d* are performed sequentially at predetermined timings. Different color images, for example, black, cyan, magenta, and yellow images, are sequentially transferred from the photoreceptors 13 in the process units 21*a*, 21*b*, 21*c*, and 21*d* in the order from the right in FIG. 1 onto the intermediate transfer belt 5, thus forming a superimposed multicolor image thereon. The upper portion extending laterally, facing the process units 21*a* through 21*d*, of the intermediate transfer belt 5 moves in the direction indicated by arrow S shown in FIG. 1.

Secondary-Transfer Process

The superimposed image is then secondarily transferred at a time from the intermediate transfer belt 5 onto the sheet transported from the sheet feeder 11. More specifically, as shown in FIG. 1, the sheets picked up from the sheet cassette 11*a* in the sheet feeder 11*a* are separated by a friction pad 25 one by one and then transported to a secondary-transfer position 29 where a secondary-transfer roller 27 is provided. The secondary-transfer roller 27 transfers the superimposed image at a time onto the sheet. Subsequently, the image is fixed on the sheet by a fixing device 31 including a fixing roller 31*a* and a heating roller 31*b*, after which a pair of discharge rollers 33 discharges the sheet to a discharge table 35. After image transfer, that is, after the intermediate transfer belt 5 passes by the image forming units 3, a cleaning unit removes any toner remaining thereon in preparation for subsequent image formation.

Configuration of Development Device

Referring to FIG. 2, a configuration of the development device is described in further detail below.

It is to be noted that the terms "supplied toner" and "remaining toner" mean toner supplied from the toner container to the development device and that remaining in the development device, respectively.

The properties of the remaining toner are typically degraded due to physical stress inherent to driving of the development device compared to unused toner (i.e., fresh toner), and thus the remaining toner is also referred to as "degraded toner". By contrast, although the supplied toner contacts the supply roller when supplied from the toner container thereto, a substantial stress is not applied thereto. Accordingly, the properties thereof are substantially the same as those of fresh toner. Therefore, hereinafter the supplied toner is also referred to as "undiminished toner". Further, the term "supplied toner ratio" means the ratio of the amount of supplied toner supplied in a single supply operation to the amount of toner present in the development device after the supply operation.

In the configuration shown in FIG. 2, the development device 17 includes a development housing 17*c* that includes a developer tank (toner containing compartment) for containing developer (i.e., toner), and development-related components such as the development roller 17*a* are housed therein. A toner container 37 is removably connected to an upper portion of the development device 17, and thus the development device 17 and the toner container 37 can be handled as a single development unit. The toner container 37 includes an agitator 41 to loosen coagulated toner and a toner supply roller 47. For example, the agitator 41 includes a rotary shaft and a blade sheets bonded to the rotary shaft. In the configuration shown in FIGS. 1 and 2, use of nonmagnetic one-component developer is preferable. It is to be noted that the features relating to a toner supply method according to the present embodiments can adapt to other configurations than those of the development unit and the toner container shown in FIGS. 1 and 2.

The development roller 17*a* serving as the developer bearer is rotatably provided inside the development housing 17*c* and rotates in the direction indicated by arrow A (counterclockwise in FIG. 2) during image formation. The development roller 17*a* includes a metal core, and an outer circumference is constructed of an electroconductive rubber overlying the metal core and having a volume resistivity from about 10E5Ω to about 10E7Ω. Examples of the electroconductive rubber include electroconductive urethane rubber and silicone rubber. For example, in the present embodiment, the hardness of the rubber is 75 Hs (JIS), the diameter of the metal core is about 6 mm, and an external diameter of the rubber is about 12 mm.

The supply roller 17*b* serving as a toner supply member rotatably contacts the development roller 17*a*. Typically, the nip between the development roller 17*a* and the supply roller 17*b* can have a width from 1 mm to 3 mm. The supply roller 17*b* rotates clockwise in FIG. 2 as indicated by arrow B and can transport the toner in the development housing 17*c* to an outer layer of the development roller 17*a* efficiently by rotating in the counter direction to the direction in which the development roller 17*a* rotates.

Typically, as the supply roller 17*b*, a sponge roller including a metal core and semiconducting foam polyurethane adhering to the metal core is preferable. Foam polyurethane can be made semiconducting by mixing carbon therein. For example, in the present embodiment, the diameter of the metal core is 6 mm, the external diameter of the sponge layer is 12 mm, the nip between the development roller 17*a* and the supply roller 17*b* has a width of about 2 mm, and the ratio of rotational frequency of the supply roller 17*b* to that of the development roller 17*a* is 1.

A doctor blade 17*d* is provided on a circumferential surface of the development roller 17*a* downstream from the nip with the supply roller 17*b* in the rotational direction of the development roller 17*a*. The doctor blade 17*d* adjusts the amount (i.e., layer thickness) of the toner supplied by the supply roller 17*b* to the surface of the development roller 17*a* to a predetermined amount. Additionally, simultaneously with the adjustment of the toner amount, the toner is frictionally charged between the doctor blade 17*d* and the development roller 17*a*.

The doctor blade 17*d* is constructed of a SUS metal plate having a thickness of about 0.1 mm and is disposed in contact with the development roller 17*a* to adjust the amount of toner carried on the development roller 17*a*. It is important to adjust the amount of toner carried on the development roller 17*a* to stabilize the development performance. For the toner amount adjustment, the contact pressure of the doctor blade 17*d* to the development roller 17*a* (typically, about 20 N/m to 60 N/m), the position of the nip (typically, about 0.5 mm±0.5 mm from the tip of the doctor blade 17*d*), and the like are set precisely in accordance with the properties of the toner, the development roller 17*a*, supply roller 17*b*, and the like.

For example, in the present embodiment, the doctor blade 17*d* is constructed of a SUS metal blade having a thickness of 0.1 mm, disposed in contact with the development roller 17*a* with a line pressure of 45 N/m, the nip is set at a position 0.2 mm away from the tip of the doctor blade 17*d*, and the length from a fixed end of the doctor blade 17*d* to the free end is 14 mm to form a uniform thin toner layer on the development roller 17*a*.

Figure 3A:
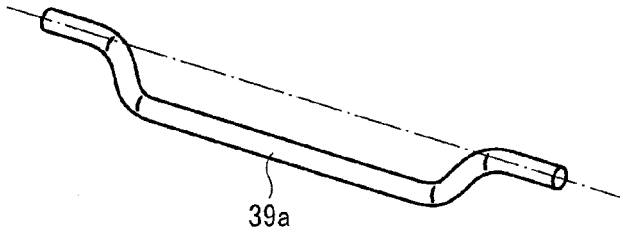
FIG. 3A is a perspective view that illustrates one configuration of a toner agitator used in the development device.
Figure 3B:
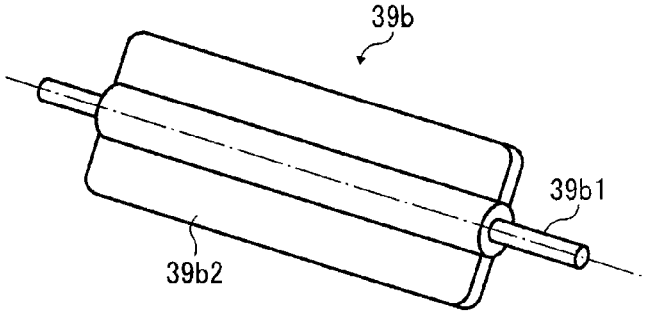
FIG. 3B is a perspective view that illustrates another configuration of the toner agitator used in the development device.

Additionally, a rotary agitator 39 serving as a toner agitator is provided inside the development housing 17*c*, adjacent to the nip between the development roller 17*a* and the supply roller 17*b*. The rotary agitator 39 rotates in the direction indicated by arrow C shown in FIG. 2 to prevent the powder pressure of the toner inside the development housing 17*c* from being concentrated on the supply roller 17*b* so that the supply roller 17*b* does not receive a great load. FIGS. 3A and 3B illustrate configurations of the rotary agitator 39. For example, as shown in FIG. 3A, the rotary agitator 39 may be a paddle 39*a* formed by bending both end portions of a metal rod having a diameter of about 0.8 mm to 2 mm. Alternatively, the rotary agitator 39 may be a resin paddle 39*b* including a rotary shaft 39*b*1 and blades 39*b*2 to agitate adjacent toner, which are molded as a single piece. Yet alternatively, a configuration similar to that of the agitator 41 may be used.

Calculation of Toner Consumption in Development Device

The controller 100 can calculates the amount of toner consumed in the development device 17 based on the printing area of images. Although electrostatic latent images are formed on the photoreceptor drum 13 by the laser beams L1 through L4 emitted from the optical scanning unit 9, the electrostatic latent images themselves are aggregates of dots set according to the image to be printed. The consumption for each dot can be estimated from various settings of the development system such as the development bias and the output power of the laser beams, environments such as temperature and humidity, in which the system is used, and dot forming conditions such as whether the image is a solid image constructed of continuous dots.

Therefore, toner consumption can be calculated from the quantity of dots printed. In other words, the output levels of digital image signals for each pixel are added together to obtain the printing ratio of the image to be printed, and then the amount of toner to be consumed is calculated therefrom. Toner supply methods using video counting are described in JP-H05-88554-A and U.S. Pat. No. 5,724,627A, and such description is hereby incorporated by reference herein in their entirety.

Detection of Remaining Toner Amount

Referring to FIG. 2, the process unit 21*a* further includes a light emitting element 43*a*, a light receiving element 43*b*, and windows 45*a* and 45*b* through which light passes, together forming a toner detector 50 to detect the amount of toner remaining in the development device 17, in particular, in the toner tank in the housing 17*c*. These components are disposed so that the light emitted from the light emitting element 43*a* passes through the window 45*a*, travels linearly inside the development device 17, passes through the window 45*b*, and reaches the light receiving element 43*b*.

Accordingly, when a sufficient amount of toner is present in the development device 17, the light emitted from the light emitting element 43*a* is blocked by the toner and does not reach the light receiving element 43*b*. After printing operation is repeatedly performed and the toner inside the development device 17 is consumed, the level of the remaining toner falls, enabling the light to reach the light receiving element 43*b*. Thus, whether the amount of toner remaining in the development device 17 is greater or smaller than a predetermined amount (first remaining amount) is detected with the detection of light by the light receiving element 43*b*. The detection result is transmitted to the controller 100, and thus the controller 100 can ascertain the remaining toner amount.

Alternatively, the amount of remaining toner may be detected by a powder detector using a piezoelectric element or piezoelectric vibration element. The powder detector includes a detection surface that slightly vibrates constantly, and the detection surface is set at a predetermined height inside the development device 17. When the detection surface of the powder detector contacts the toner, vibration thereof is restricted. Thus, the powder detector can detect whether the detection surface contacts the toner, thereby detecting whether the amount of toner remaining in the development device 17 is greater or smaller than the predetermined amount.

Next, supply of toner to the development device is described below.

As described above with reference to FIG. 2, the toner container 37 for containing toner supplied to the development device 17 is removably attached to the upper portion of the development housing 17*c*. The toner container 37 includes the agitator 41 and the toner supply roller 47, which are driven in synchronization.

A supply outlet 38 is formed in a bottom portion of the toner container 37 and communicates with the development housing 17*c*, and the toner supply roller 47 is positioned in the supply outlet 38. The toner supply roller 47 can be constructed of a sponge roller, for example. The toner is supplied through the supply outlet 38 to the development housing 17*c*, and the amount is set with the driving time of the toner supply roller 47. The controller 100 controls driving of a drive source of the toner supply roller 47. That is, to increase the amount of supplied toner for each supply operation, the driving time is increased, and, to reduce the amount of supplied toner, the driving time is decreased. Thus, the amount of supplied toner can be adjusted with the driving time of the toner supply roller 47.

It is to be noted that, alternatively, the amount of supplied toner may be adjusted by varying the driving velocity of the toner supply roller 47. In this case, even with the identical driving period, the toner supply amount can be reduced by slowing the driving velocity and can be increased by increasing the driving velocity.

Next, a toner supply control method according to the present embodiment is described below with reference to FIGS. 4 and 5.

Figure 4:
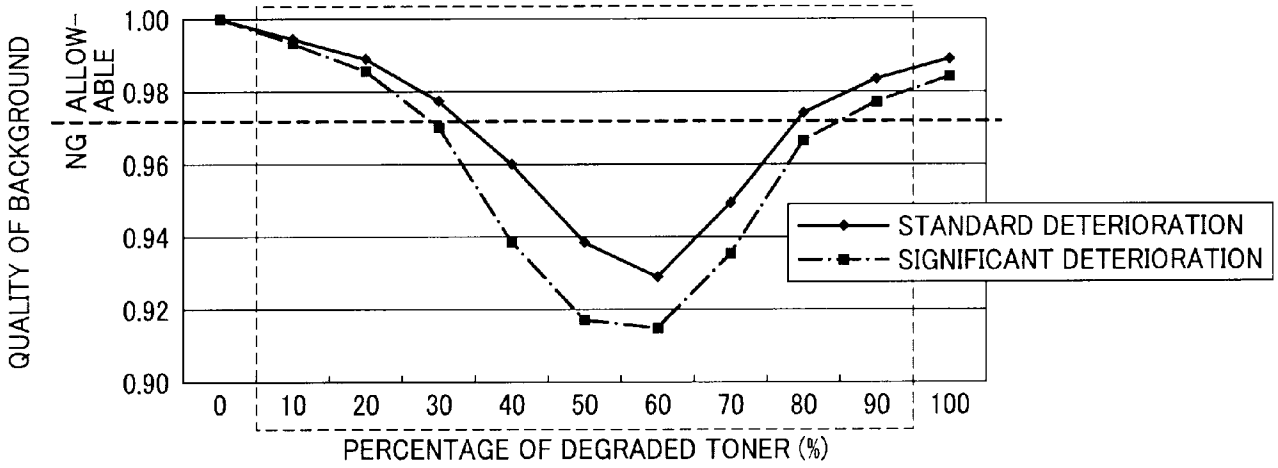
FIG. 4 is a graph that illustrates the relation between toner mixing conditions and toner scattering on the background.

FIG. 4 is a graph that illustrates results of a printing test to evaluate toner scattering (toner spots) on the background of images.

In the printing test, mixing conditions of remaining toner (degraded toner) and supplied toner (undiminished toner) were changed, that is, the ratio of remaining toner to supplied toner was varied. Toner scattering in a non image area of a printed sheet was measured by an X-Rite Spectrodensitometer.

A nonmagnetic one-component developer (toner) was used, and the toner remaining in the development device 17 after formation of a predetermined amount of images and the supplied toner were mixed at different ratios, producing multiple different toner mixtures. The multiple different toner mixture were sequentially put in the development device 17 of the printer used in the test. Two different types of degraded toners, a toner subjected to 25 hours of printing as a degraded toner in typical usage conditions (hereinafter "standard degraded toner") and a toner subjected to 50 hours of printing as a severely degraded toner, were used.

In FIG. 4, diamonds represent the standard degraded toner and squares represent severely degraded toner. The horizontal axis and vertical axis in FIG. 4 indicate the percentage of the degraded toner in the toner mixture and the quality level of the background, respectively. The quality level 1 represents the quality level when undiminished toner (undiminished toner 100%) is used. In the configuration shown in FIGS. 1 and 2, use of nonmagnetic one-component developer is preferable.

As shown in FIG. 4, when the undiminished toner is used, the background quality level is excellent with the amount of toner scattering smallest, and, when only the degraded toner is used, the background quality level is lowered with the amount of toner scattering increased. Further, when the degraded toner and the undiminished toner are mixed, the amount of toner scattering is greater than the case in which only the degraded toner is used.

Generally, the toner inside the development device receives a physical stress inherent in the driving of the development device, and thus properties of the degraded toner or remaining toner, such as a charge property and fluidity, are degraded. More specifically, the remaining toner has been repeatedly transported by the supply roller 17*b* to the development roller 17*a*, adjustment on the development roller 17*a* by the doctor blade 17*d*, development in the nip between the development roller 17*a* and the photoreceptor drum 13, and collection by the supply roller 17*b*. Because the remaining toner is thus subjected to continuous physical stress, an external additive can be removed from the toner or toner itself can be broken. As a result, the properties of the remaining toner are generally changed or degraded.

Further, when the degraded toner and the undiminished toner are mixed, the interaction therebetween makes their properties more unstable, thus increasing the amount of toner scattering further.

A background quality level allowable in practical use is, for example, 0.97 or greater in FIG. 4. Therefore, assuming that the toner is used in standard usage conditions, the percentage of the degraded toner in the toner mixture should be 78% or greater, or 35% or smaller for satisfactory image quality. In other words, the supplied toner ratio (percentage) in the toner mixture is 22% or less, or 65% or greater.

It is to be noted that maintaining the supplied toner ratio of 65% or greater may be difficult because the supply amount for each supply operation is excessive. More specifically, when the amount of remaining toner in the development device 17 is set at, for example, 90 grams (the rationale for this amount will be described later) under standard usage conditions, the required toner supply amount for each supply operation is 167.1 grams or greater to maintaining the supplied toner ratio of 65% or greater.

Therefore, the development device needs to have a toner storage capacity of approximately 257 grams, which is the sum of the amount of remaining toner and the toner supply amount for each supply operation, and this means the development unit increases in size. Moreover, if a large amount of toner is supplied in each supply operation, it is possible that development conditions such as the development bias can vary significantly, making the image forming system unstable, which is not desirable.

By contrast, when the amount of remaining toner in the development device 17 is set at 90 grams as described above and the supplied toner ratio is set at 22% or less to attain an allowable background quality in FIG. 4, the required toner supply amount for each supply operation is 25.4 grams or smaller. Accordingly, the required toner containing capacity of the development device is about 115 grams, and thus the development unit can be kept compact. Additionally, when the toner supply amount for each supply operation is relatively small, changes in the properties of the toner can be small, and thus the image forming system can be kept stable.

Therefore, it is preferable that the toner supply amount for each supply operation be smaller, that is, the supplied toner ratio be smaller. Additionally, as shown in FIG. 4, the range of supplied toner ratio to attain an allowable background quality is reduced when the deterioration of the toner is severe (indicated by square spots in FIG. 4). Accordingly, it is preferable that the supplied toner ratio be set at not 22% or less but 15% or less in practical use.

Further, it is preferable to control the supplied toner ratio with a higher degree of precision because the level of toner scattering on the background changes with changes in toner mixing ration as can be known from FIG. 4.

The toner used in the test for evaluating toner scattering on the background is described below.

The toner used in the above-described test has a volume average particle size of 8.5 μm. To produce the toner, a polyester resin, which is a main ingredient, wax, and pigment are kneaded and pulverized, thereby producing the toner base, and then one part by weight of silica is externally added to 100 parts by weight of toner base. The toner thus produced has properties similar to those of various commercially available toners for laser beam printers.

It is to be noted that the properties of the nonmagnetic one-component pulverized developer (i.e., pulverized toner), used in the above-described test for evaluating toner scattering on the background, are typical of nonmagnetic one-component developers, and polymerized toners also have substantially similar properties. Even when the developer is magnetic one-component developer or two-component developer, it is preferred to supply a relatively small amount of toner in multiple times to restrict changes in the properties of the toner.

It is to be noted that the features of the present invention can adapt to not only configurations using nonmagnetic one-component developer but also configurations using other developers such as polymerized toner, magnetic one-component toner, or magnetic two-component developer, and similar effects can be attained.

Next, the amount of toner supplied is described in further detail below.

In the description below, it is assumed that the amount of remaining toner (first remaining amount) is 90 grams and the supplied toner ratio is 10% as an example. To set the mount of remaining toner at 90 grams, the threshold of the toner detector 50 to detect the amount of toner remaining in the development device 17 is set to 90 grams. That is, the toner detector 50 detects whether the amount of toner remaining in the development device 17 is greater or smaller than 90 grams.

Figure 5:
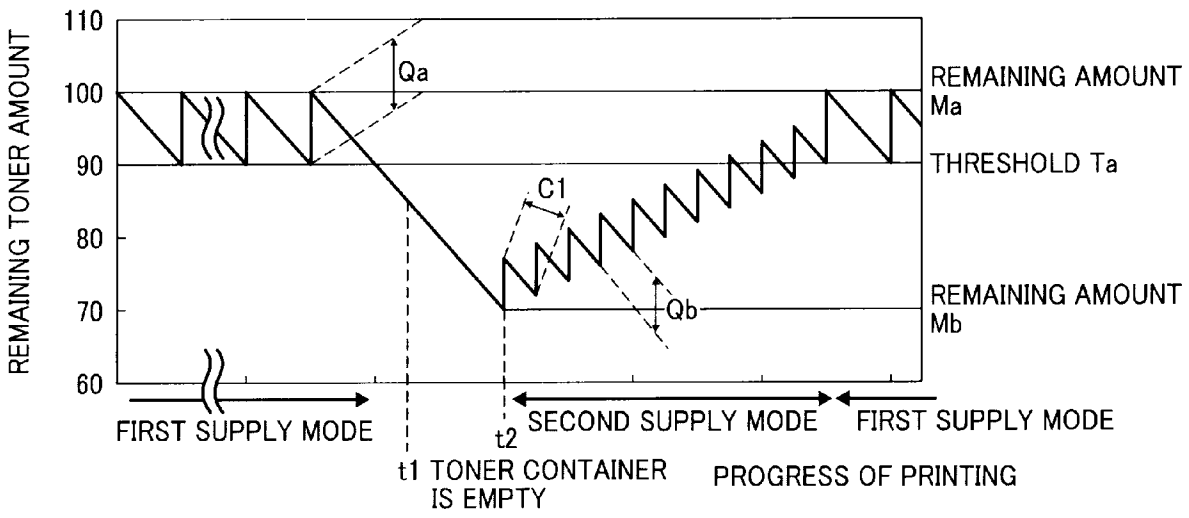
FIG. 5 is a graph illustrating the amount of toner remaining in the development unit when toner supply is controlled according to an illustrative embodiment.

Herein, in configurations in which toner is supplied from toner containers to the development devices as in the present embodiment, it is preferable that two or more supply modes, including a first supply mode as a standard supply mode and a second supply mode to be performed after toner container replacement, be available as shown in FIG. 5.

In the description below, two different supply modes, namely, the first supply mode (also "standard supply mode") and the second supply mode (also "supply mode after replacement"), are set. It is to be noted that the number of supply modes may be three or greater in view of the process control and environment adjustment depending on matching of the image forming system.

FIG. 5 is a graph illustrating the amount of remaining toner and the amount of supplied toner in each supply mode. In FIG. 5, the horizontal axis indicates progress of printing and the supply mode, and the vertical axis indicates the amount of remaining toner.

At both ends of the graph in FIG. 5, the development system is in the standard supply mode and the supplied toner is present in the toner container 37. In this state, when the toner remaining in the development device 17 is consumed and the toner detector 50 detects that the amount of remaining toner is not greater than a predetermined threshold Ta (first remaining amount), for example, 90 grams, a predetermined amount (first supply amount) Qa of toner is supplied from the toner container 37 to the development device 17. Thus, the ratio of supplied toner to the remaining toner can be kept substantially constant. More specifically, to keep the supplied toner ratio at about 10%, the first supply amount Qa is 10 grams, and the toner remaining amount after toner supply (Ma in FIG. 5) is 100 grams. Thus, in the standard supply mode, the amount of supplied toner can be kept substantially constant.

The toner in the toner container 37 is further consumed with the progress of printing, and the toner container 37 becomes empty. In this state, even when the toner detector 50 detects that the amount of remaining toner is not greater than the threshold Ta (first remaining amount), for example, 90 gram in FIG. 5, toner is not supplied to the development device 17 as in a lateral center portion in FIG. 5. When the toner detector 50 recognizes that the amount of remaining toner in the development device 17 does not increase even after a predetermined number of times the supply operation is repeated, it is determined that the toner container 37 is empty at timing t1 in FIG. 5. The toner in the development device 17 is further consumed during this period. Accordingly, when the toner container 37 is regarded as empty, the amount of toner remaining in the development device 17 is smaller than that during the period in which the development system is in the standard supply mode.

If printing becomes unfeasible at the moment the toner container 37 is regarded as empty, users cannot execute printing until the empty toner container 37 is replaced. Therefore, image forming apparatuses are generally configured to be able to form a predetermined quantity of images with the toner remaining in the development device even when the toner container 37 is empty. More specifically, when the image forming apparatus 1 has a capability to prompt the user to replace the toner container, continuation of printing up to a predetermined quantity can be assured. For example, the controller 100 can have such a capability.

Although it depends on the configuration of the development device, in typical development devices such as the one shown in FIG. 2, it is necessary for the development device to have at least 30 grams to 40 grams of remaining toner to maintain a satisfactory image quality of so-called solid images having a relatively high printing ratio. For this reason, the above-described threshold Ta (first remaining amount) in standard usage conditions is set at 90 grams. When the amount of toner consumed until the toner container 37 is regarded as empty is M1, the amount of toner consumed from when the toner container is regarded as empty to when the toner container is replaced is M2, and the amount of remaining toner required for satisfactory image quality is M3 (30 grams to 40 grams), the first remaining amount is preferably the sum of M1, M2, and M3, which in the configuration shown in FIG. 5 is 90 grams.

When implemented in commercial products, the toner amount M2 consumed from when the toner container is regarded as empty to when the toner container is replaced can be set arbitrarily. Thus, in practice, 40 grams or greater may be sufficient as the amount of remaining toner in standard usage conditions, and the toner supply amount can be set in accordance with the amount of remaining toner.

In the above-described configuration, a remaining amount Mb at the time of toner container replacement at timing t2 in FIG. 5 may be only 40 grams. After toner container replacement, if the toner supply amount in this state is equal or similar to the first supply amount Qa in the standard supply mode (10 grams), the supplied toner ratio would be 20%, which is not desirable. More specifically, because the supplied toner ratio of 20% immediately after the replacement is doubled from the supplied toner ratio of 10% in the standard supply mode, the toner scattering on the background increases, degrading the background quality as shown in FIG. 4. Consequently, defective images might be produced depending on error in the toner supply amount or usage conditions.

Therefore, in the present embodiment, after toner container replacement, toner is supplied in the second supply mode (supply mode after replacement) different from the standard supply mode.

Descriptions are given below of specific features of the toner supply control according to the present embodiment based on the relation between the toner mixing conditions and the toner scattering on the background.

Feature 1: Two different supply modes, first and second supply modes, are available.

Feature 2: The timing of toner supply in the second supply mode is determined in accordance with toner consumption (C1 in FIG. 5).

Feature 3: The toner consumption C1 as a threshold for executing toner supply in the second supply mode is smaller than a second toner supply amount (Qb in FIG. 5) in the second supply mode.

The features 1 to 3 are described in further detail below with reference to FIG. 5.

Regarding the feature 1, it is considered that characteristics of background toner scattering are dependent on the supplied toner ratio in the present embodiment. Therefore, the two different toner supply modes are set, and the second supply amount Qb after toner container replacement is reduced from the first supply amount Qa in the standard supply mode so that the supplied toner ratio in the standard supply mode and that in the toner supply mode after replacement can be the same or similar.

In the above-described control, when the second supply amount Qb for each supply operation in the toner supply mode after replacement is 4.4 grams, the supplied toner ratio of 10% can be attained. Thus, even after toner container replacement, the background quality can be equal or similar to that in the standard toner supply mode.

As an additional effect, because the supplied toner ratio can be kept constant, development conditions can be stable.

Regarding the feature 2, although the supplied toner ratio can be kept constant by setting the development system in either of the two different toner supply modes as required, the amount of toner remaining in the development device 17 before toner container replacement is about 90 grams to 100 grams (the sum of the remaining toner, 90 grams, and the supplied toner, 10 grams, is 100 grams), whereas the remaining toner amount after toner container replacement is about 40 grams to 44 grams (the sum of remaining toner, 40 grams, and the supplied toner, 4.4 grams, is 44.4 grams). Because the toner detector 50 for detecting the remaining toner amount detects whether the remaining amount is greater or smaller than the threshold Ta (90 grams in the above-described configuration), after toner container replacement, the timing at which the toner is supplied from the toner container 37 cannot be detected with the toner detector 50.

In view of the foregoing, in the present embodiment, in the toner supply mode after replacement, the toner consumption is calculated according to the above-described calculation method, and the toner is supplied when the calculated toner consumption reaches the predetermined threshold C1 (toner supply timing).

With this control, after toner container replacement, the toner supply timing can be detected without using the toner detector 50 for detecting the remaining toner amount.

When printing is continued and a given amount of images are output using only the remaining toner as described above, the amount of toner remaining in the development device 17 is reduced to about 40 grams to 44 grams. That is, the amount is significantly reduced from the amount before toner container replacement, which is about 90 grams to 100 grams. When the amount of toner remaining in the development device 17 is small, it is possible that each toner particle receives greater stress from the development blade 17*d* or the supply roller 17*b* compared with a state in which the amount of remaining toner is larger. Consequently, deterioration of toner tends to be accelerated even if the number of output sheets is the same.

Therefore, as the feature 3, the predetermined toner consumption C1 is set at a amount smaller than the predetermined supply amount Qb in the supply mode after replacement, described in the feature 2.

More specifically, for example, in a case in which the predetermined threshold C1 of the toner consumption is set at 3 grams and the second supply amount Qb is 4.4 grams, in the supply mode after replacement, 4.4 grams of toner is supplied each time 3 grams of toner is consumed. In other words, in the supply mode after replacement, the amount of toner remaining in the development device 17 is increased by 1.4 grams with each supply operation. Thus, deterioration of toner remaining in the development device 17 can be slowed effectively by repeatedly supplying the toner little by little, the amount of which slightly greater than the toner consumption. When the toner consumption threshold C1 and the supply toner amount Qb are respectively 3 grams and 4.4 grams, the supply amount in each supply operation is 1.47 times as great as the toner consumption.

As printing progresses and this supply operation is repeated, the amount of toner in the development device 17 reaches 90 grams as shown on the right in FIG. 5, which is the threshold Ta for detecting the remaining toner amount. Then, the toner detector 50 recognizes that the remaining toner amount is 90 grams or greater, and the development system enters the standard supply mode again.

Control Flow of Toner Supply

Figure 6:
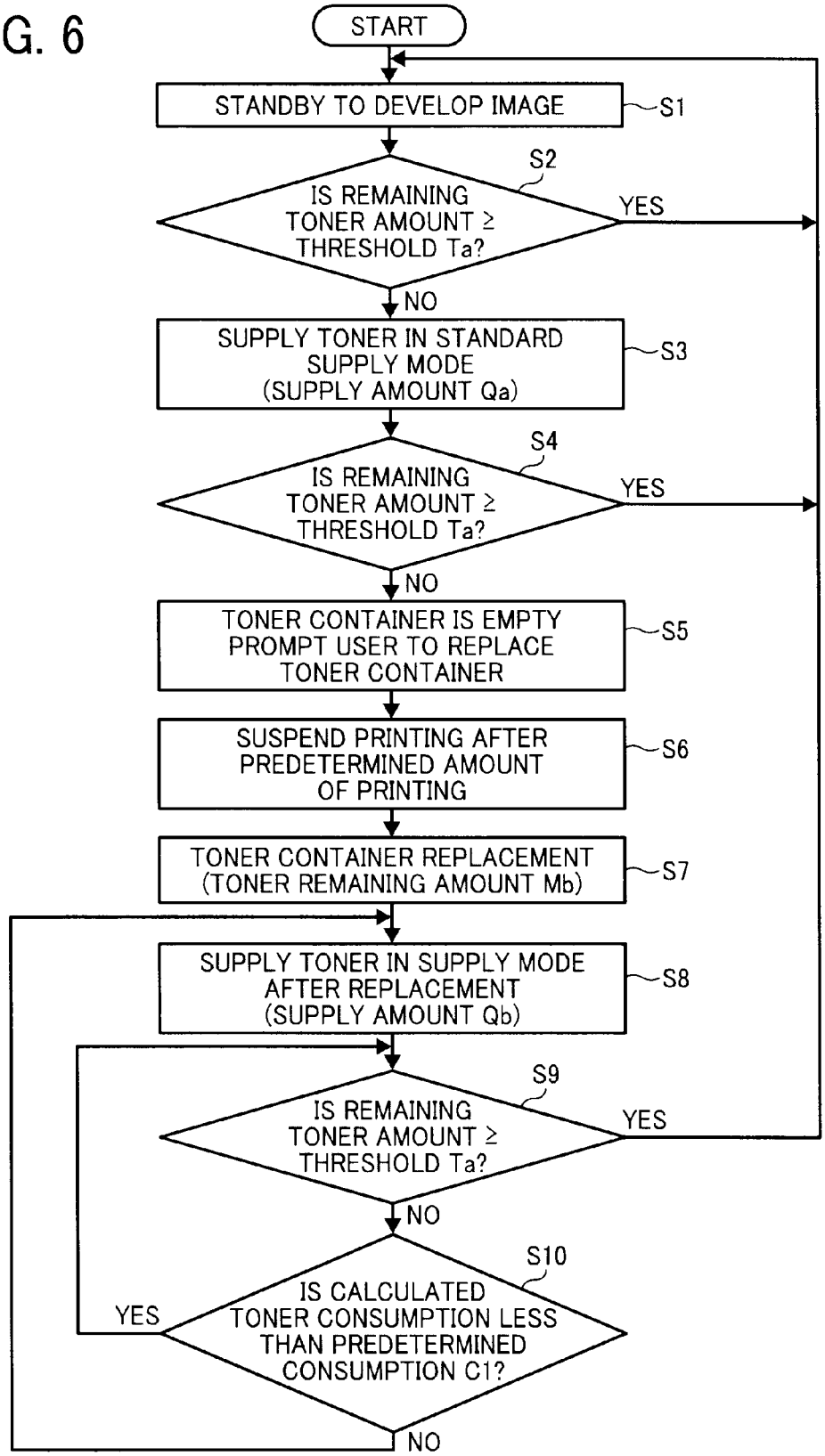
FIG. 6 is a flowchart of toner supply control according to an illustrative embodiment.

FIG. 6 is a flowchart illustrating a typical procedure of the toner supply described with reference to FIG. 5. Referring to FIG. 6, at S1, the development system is on standby to develop an image. At S2, when printing operation is started, the toner detector 50 detects the amount of remaining toner in the development device 17. When the remaining toner amount is equal to or greater than the threshold Ta (Yes at S2), the process returns to S1, and the development system is on standby to develop a subsequent image. By contrast, when the remaining toner amount is smaller than the threshold Ta (No at S2), the process proceeds to S3, and the toner supply operation is performed once. That is, the first supply amount Qa of toner is supplied from the toner container 37. At S4, the toner detector 50 detects the remaining toner amount similarly to S2. When the remaining toner amount is equal to or greater than the threshold Ta (Yes at S4), the process returns to S1, and the development system is on standby to develop a subsequent image. By contrast, when the remaining toner amount is smaller than the threshold Ta (No at S4), the process proceeds to S5.

At S5, because the remaining toner amount does not reach the threshold Ta even after the supply operation is executed once, the toner container 37 is deemed empty. Then, the controller 100 causes a display to display a message to prompt the user to replace the toner container 37. It is to be noted that the steps S2, S4, and S5 are performed in parallel to printing operation. Subsequently, at S6 after the predetermined amount of images are printed, printing operation is suspended until replacement of the toner container is completed. At that time, the remaining toner amount is Mb as shown in FIG. 5, and at S7, the toner container 37 is replaced with a new one. At S8, the system enters the supply mode after replacement, and a toner supply operation is performed with the second supply amount Qb. At S9, the toner detector 50 detects the amount of remaining toner in the development device 17. When the remaining toner amount is not less than the threshold Ta (Yes at S9), the process returns to S1. By contrast, when the remaining toner amount is less than the threshold Ta (No at S9), the process proceeds to S10, and the toner consumption is calculated. When the toner consumption calculated at S10 is less than the predetermined toner consumption C1 (Yes at S10), the process returns to S9. By contrast, when the calculated toner consumption is not less than the predetermined toner consumption C1 (No at S10), the process returns to S8, and the toner supply is performed again with the second supply amount Qb.

Among the steps thus performed in the control flow of toner supply, steps 3 and 8 relate to the above-described feature 1. The supply toner ratio in supplying the first supply amount Qa of toner at S3 can be expressed as:

$$R1=Qa/Ta+Qa$$

wherein R1 and Ta represent the supply ratio and the remaining toner threshold, respectively.

The supply ratio in supplying the second supply amount Qb of toner at S8 can be expressed as:

$$R2=Qb/Mb+Qb$$

wherein R2 and Mb respectively represent the supply toner ratio and the remaining toner amount at the time of replacement. The feature 1 is for controlling toner supply so that the supply toner ratios 1 and 2 can be kept to a similar value or within similar range.

The steps 2, 8, and 10 relate to the above-described features 2 and 3. The supply toner ratio R2 at S8 is expressed as Qb/Mb+Qb as described above, and the supply operation in the supply mode after replacement is performed when the calculated toner consumption reaches the predetermined toner consumption C1 (C1<Qb).

The toner consumption is calculated, using video counting as described above, by accumulating the amount of toner consumed in printing executed each time after the second supply amount Qb of toner is supplied in supply mode after replacement. It is to be noted that the accumulative toner consumption is reset each time the toner container is replaced. More specifically, the development device 17 is provided with a detector to detect whether the toner container 37 is attached thereto, and the accumulative toner consumption is reset in response to signals transmitted from the detector.

Further, other procedures that are not identical but similar to that shown in FIG. 6 are within the scope of the present invention.

For example, although, in the procedure shown in FIG. 6, the toner amount detector 50 used at S2 constantly detects whether the remaining toner amount is greater than the threshold Ta during printing operation, alternatively, the remaining toner amount may be detected each time a printing operation, for example, a single job, is completed. Yet alternatively, the image forming apparatus may be configured so that printing is feasible during the toner supply operation in the standard supply mode.

Further, the step S6 may be omitted in a configuration in which printing is prohibited immediately after the toner container is deemed empty. In such a case, although the apparatus does not report to the user that replacement of the toner container will be required shortly, printing operation is not affected.

Additionally, one or more additional supply modes may be provided.

Next, effects of the present embodiment are described below.

A printing test was executed to evaluate effects of the present embodiment under three different printing conditions. The configurations of the image forming apparatus and the development device; properties of toner; and the like used in the test are similar to those in the above-described embodiment unless otherwise specified.

Common Conditions

In the standard supply mode, the remaining toner threshold Ta was 90 grams and the first supply amount Qa was 10 grams. For determining when to supply toner in the supply mode after replacement, the remaining toner amount Mb was 50 grams and the toner capacity of the toner container was 230 grams.

In each printing job, images with a printing ratio of 5% were output on three sheets under a temperature of 22° C. and a humidity of 50%.

Case 1

In case 1 is a comparative example, the supply mode after replacement was not used, and a relatively large amount of toner was supplied after toner container replacement.

More specifically, in the comparative example, 50 grams of toner was supplied once immediately after toner container replacement, after which the toner was supplied in the standard supply mode. In this method, the remaining toner amount was sharply increased from 50 grams to 100 grams, and the supply toner ratio was 50%.

Case 2

In case 2, toner was supplied according to the above-described embodiment.

More specifically, after the toner container was replaced, the toner supply mode was shifted to the second supply mode (supply mode after replacement), in which the second supply amount Qb was 5 grams, which means that the supply toner ratio was 10%, and the predetermined toner consumption C1 was 3 grams. The toner was supplied according to the control flow shown in FIG. 6.

Figure 7:
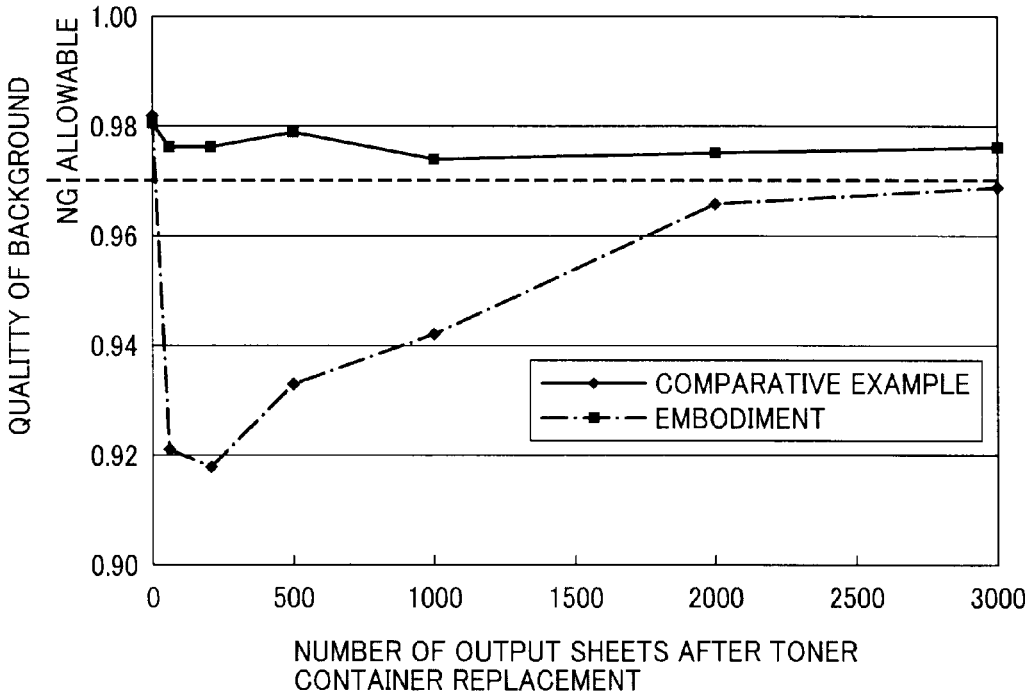
FIG. 7 is a graph illustrating the level of toner scattering as effects of the embodiment.

FIG. 7 illustrates the relation between the background quality and the number of sheets output just after toner container replacement.

In case 1 (comparative example) in which the features of this disclosure were not applied, the toner scattering on the background was dramatically increased, that is, the background quality significantly deteriorated, immediately after toner container replacement. Accordingly, a satisfactory image quality could not maintained. By contrast, in case 2, the toner scattering on the background were restricted even after toner container replacement, and a satisfactory image quality was maintained.

As described above, in the above-described embodiment, there are two supply modes for supplying toner to the development device 17. When the remaining toner amount in the development device is reduced to or below the second remaining amount smaller than the first remaining amount, the supply mode is switched to the second supply mode, and the amount of supplied toner is changed to the second supply amount smaller than the first supply amount in the first supply mode. Therefore, fluctuations in the supplied toner ratio can be reduced.

In the toner supply method according to the above-described embodiment, the ratio of the first supply amount to the first remaining amount is equal or similar to the ratio of the second supply amount to the second remaining amount. Accordingly, the supplied toner ratio can be kept substantially constant.

Further, in the second supply mode, after the initial supply operation with the second supply amount, the subsequent supply operation is performed each time after a given amount of toner smaller than the second supply amount is consumed. Thus, the remaining toner amount can be increased substantially linearly to the first remaining amount by supplying the second supply amount of toner repeatedly. Accordingly, the toner mixing condition in the development device 17 can be stable.

Further, because the amount of toner consumed by the development device 17 can be calculated according to the printing ratio of images developed, the timing at which the second amount of toner is supplied can be controlled properly. Therefore, developing performance can be stabilized, thus reducing toner scattering on the background and enhancing the image quality.

Additionally, fresh toner is supplied from a removably attachable toner container 37 such as a toner cartridge. After the toner cartridge becomes empty and accordingly the amount of toner remaining in the development device 17 is reduced from the first remaining amount to the second remaining amount, the toner cartridge is replaced. Then, the toner supply mode is changed from the first supply mode to the second supply mode.

The second remaining amount is equal to the amount of toner remaining in the development device at the time of toner cartridge replacement. Therefore, the replacement of toner cartridge does not aggravate developing performance, toner scattering on the background, and image quality.

Additionally, because the toner detector 50 detects whether the amount of toner remaining in the development device 17 is reduced to the first remaining amount, the toner supply timing in the first supply mode can be controlled properly.

Further, after the toner container 37 becomes empty, image development is feasible until the amount of toner remaining in the development device 17 reduces to the second remaining amount, that is, the predetermined or given quantity of images can be developed in this state. When development of the predetermined quantity of images is completed, the remaining toner amount is deemed below the second remaining amount. Therefore, the timing at which the second supply amount of toner is supplied can be controlled properly.

Numerous additional modifications and variations are possible in light of the above teachings. It is therefore to be understood that, within the scope of the appended claims, the disclosure of this patent specification may be practiced otherwise than as specifically described herein.

What is claimed is:

1. A toner supply method to supply toner from a replaceable toner container to a development device, the method comprising:

detecting whether a remaining toner amount in the development device is equal to or greater than a first remaining amount;

supplying a first supply amount of toner to the development device in a first supply mode when the remaining toner amount is not greater than the first remaining amount;

detecting whether the remaining toner amount in the development device is equal to or greater than a second remaining amount smaller than the first remaining amount; and supplying a second supply amount, smaller than the first supply amount, of toner to the development device in a second supply mode when the remaining toner amount is reduced to or below the second remaining amount.

2. The method according to claim 1, wherein a first supply toner ratio of the first supply amount to the first remaining amount is equal to a second supply toner ratio of the second supply amount to the second remaining amount.

3. The method according to claim 1, further comprising:

estimating toner consumption after an initial supply operation with the second supply amount in the second supply mode; and performing a subsequent supply operation with the second supply amount in the second supply mode when toner consumption after the initial supply operation reaches a predetermined toner consumption amount smaller than the second supply amount.

4. The method according to claim 3, wherein the toner consumption after the initial supply operation with second supply amount is calculated according to a printing ratio of an image developed by the development device.

5. The method according to claim 1, further comprising:

replacing the toner container after the remaining toner amount is reduced to the second remaining amount, wherein toner supply mode is shifted to the second supply mode after the toner container is replaced.

6. The method according to claim 5, further comprising:

deeming the toner container empty when the remaining toner amount in the development device is not increased above the first remaining amount after the first supply amount of toner is supplied thereto.

7. The method according to claim 1, wherein the second remaining amount is set to an amount of toner remaining in the development device after the toner container is replaced with a new one and before toner is supplied from the new toner container.

8. The development device according to claim 1, wherein the toner detector to detect the remaining toner amount in the toner containing compartment comprises:

a light-emitting element; and a light-receiving element.

9. The development device according to claim 1, wherein the toner detector to detect the remaining toner amount in the toner containing compartment comprises a piezoelectric element.

10. A development device comprising:

a casing defining a toner containing compartment for containing toner, in which a toner supply inlet to connect to a replaceable toner container is formed;

a cylindrical toner carrier partially exposed from the casing of the development device to carry the toner to a development range; and a toner detector to detect a remaining toner amount in the toner containing compartment, wherein, when the remaining toner amount is not greater than a first remaining amount, a first supply amount of toner is supplied from the toner container to the toner containing compartment in a first supply mode, and when the remaining toner amount is reduced to or below a second remaining amount smaller than the first remaining amount, a second supply amount smaller than the first supply amount of toner is supplied to the toner containing compartment in a second supply mode.

11. The development device according to claim 10, wherein a first supply toner ratio of the first supply amount to the first remaining amount is equal to a second supply toner ratio of the second supply amount to the second remaining amount.

12. The development device according to claim 10, wherein toner consumption after an initial supply operation with the second supply amount in the second supply mode is estimated, and when toner consumption after the initial supply operation reaches a predetermined toner consumption amount smaller than the second supply amount, the second supply amount of toner is again supplied to the toner containing compartment in the second supply mode.

13. The development device according to claim 12, wherein toner consumption after the initial supply operation with second supply amount is calculated according to a printing ratio of an image developed by the development device.

14. The development device according to claim 10, wherein, after the remaining toner amount is reduced to the second remaining amount, the toner container is replaced, and toner supply mode is shifted to the second supply mode after the toner container is replaced.

15. The development device according to claim 14, wherein the replaceable toner container is deemed empty when the remaining toner amount in the development device is not increased above the first remaining amount after the first supply amount of toner is supplied thereto.

16. The development device according to claim 10, wherein the second remaining amount is equal to an amount of toner remaining in the development device after the toner container is replaced with a new one and before toner is supplied from the new toner container.

17. The development device according to claim 10, wherein the toner detector to detect the remaining toner amount in the toner containing compartment comprises:

a light-emitting element; and a light-receiving element.

18. The development device according to claim 10, wherein the toner detector to detect the remaining toner amount in the toner containing compartment comprises a piezoelectric element.

19. The development device according to claim 10, wherein, after the replaceable toner container becomes empty, image development is continued until the remaining toner amount in the toner containing compartment is reduced to the second remaining amount.

20. An image forming apparatus, comprising:

an image bearer on which an electrostatic latent image is formed;

a development device to develop the latent image with toner, the development device including a casing defining a toner containing compartment for containing toner, in which a toner supply inlet to connect to a replaceable toner container is formed, a cylindrical toner carrier partially exposed from the casing of the development device to carry the toner to a development range, and a toner detector to detect a remaining toner amount in the toner containing compartment; and a controller operatively connected to the development device, wherein, when the remaining toner amount is not greater than a first remaining amount, a first supply amount of toner is supplied from the toner container to the toner containing compartment in a first supply mode, and when the remaining toner amount is reduced to or below a second remaining amount smaller than the first remaining amount, a second supply amount, smaller than the first supply amount, of toner is supplied to the toner containing compartment in a second supply mode.

* * * * *